US005682168A

United States Patent [19]

James et al.

[11] Patent Number: 5,682,168

[45] Date of Patent: Oct. 28, 1997

[54] HIDDEN VEHICLE ANTENNAS

[75] Inventors: Jesse C. James, Huntsville; James B. Blackmon, Jr., Brownsboro, both of Ala.

[73] Assignee: McDonnell Douglas Corporation, Huntington Beach, Calif.

[21] Appl. No.: 650,682

[22] Filed: May 20, 1996

[51] Int. Cl.[6] ..... H01Q 1/32

[52] U.S. Cl. ..... 343/713; 343/711; 343/810

[58] Field of Search ..... 343/712, 713, 343/711, 810, 812, 814, 813; H01Q 1/32

[56] References Cited

U.S. PATENT DOCUMENTS

| | | | |
|---|---|---|---|
| 2,129,852 | 9/1938 | Leib | 343/705 |
| 2,520,987 | 9/1950 | Williams et al. | 343/711 |
| 2,774,811 | 12/1956 | Shanok et al. | 343/711 |
| 2,923,813 | 2/1960 | Davis | 343/712 |
| 3,623,108 | 11/1971 | DuBois | 343/712 |
| 3,961,330 | 6/1976 | Davis | 343/712 |
| 4,707,700 | 11/1987 | Nagy | 343/712 |
| 4,758,166 | 7/1988 | Bonnett et al. | 343/712 |
| 4,804,966 | 2/1989 | Ohe et al. | 343/712 |
| 4,811,025 | 3/1989 | Ohe et al. | 343/712 |
| 5,177,494 | 1/1993 | Dörrie et al. | 343/711 |
| 5,532,709 | 7/1996 | Talty | 343/713 |

*Primary Examiner*—Hoanganh T. Le

*Attorney, Agent, or Firm*—Bell, Seltzer, Park & Gibson, P.A.

[57] ABSTRACT

One or more antenna elements are submerged beneath a faired cover over a roof supporting member of a motor vehicle or hidden behind or as part of the front grill. Usually a conductive support extends behind the antenna elements and are electrically isolated therefrom to form the ground plane of the antenna. In some cases the antennas can be the structural members electrically isolated from the remainder of the body, but physically connected thereto. RF absorbers may be positioned spaced from radiating antenna elements to prevent antenna cross talk and exposure of occupants of the vehicle to high RF power densities. The antenna elements are especially useful in providing collision avoidance radar.

19 Claims, 7 Drawing Sheets

HIDDEN VEHICLE ANTENNAS

FIELD OF THE INVENTION

The present invention relates to antennas for motor vehicles that are hidden in the roof supports and grills thereof and systems using such antennas.

BACKGROUND OF THE INVENTION

Motor vehicles now commonly require multiple antennas, including antennas for AM and FM radio reception, global positioning system (GPS) satellite reception, automated radio control door locks and cellular telephones. In the future, it is contemplated that additional antennas such as those for collision avoidance radar, computer satellite up-link and down-links and broadcast television will be increasingly more common. In addition, users like police and amateur radio operators require communications antennas for frequency bands not otherwise commonly used.

At present, most of the motor vehicle antennas are whip, wire, or blade antennas that protrude above the roof, the trunk, or a fender, or are embedded in the front windshield. Some of the antennas have a matching coil at their base to reduce their overall height. Some, such as for AM and FM broadcast radio, are motor-driven telescoping whip antennas so they can be hidden below the motor vehicle's surface when not in use. In some instances, small wires have been imbedded in the front windshields to provide an antenna for AM and FM broadcast radio, but such are expensive and the antenna connections thereto are fragile. After a while, motor driven telescoping antennas tend to stick so they no longer completely retract into a body panel, and there is not enough room in the front windshield for all of the antennas required, the rear windshield usually including defogging apparatus thereon that effectively prevents its use as a location for an internal antenna.

Any antenna that at any time protrudes from the motor vehicle's body is subject to damage, such as accidental damage from car washes, passing trees and shrubbery, and debris and intentional damage from vandals.

It is desirable that radiating antennas, such as collision avoidance radar antennas and cellular telephone antennas be as far from the occupants of a vehicle as possible or that the occupants be shielded therefrom as there is an expanding body of evidence that indicates exposure to low levels of RF radiation can be harmful. In addition, a radiating antenna closely spaced from another radiating antenna or receiving antenna is likely to "crosstalk" or interfere with the proper operation of antennas.

Therefore, there has been a need to provide antennas for motor vehicles, which can be constructed to operate at a wide band of frequencies, and which are hidden and not accessible under normal circumstances.

SUMMARY OF THE INVENTION

In the present invention, antennas are formed using portions of supporting or decorative members of a motor vehicle, such as along the sides of the windows or within decorative trim perhaps provided for that purpose. In some cases the antennas can be the structural members electrically isolated from the remainder of the body, but physically connected thereto.

The present invention contemplates the use of dipole, folded dipole, and dipole array antenna elements closely backed by conductive structure of the vehicle. The elements are spaced from the conductive structure by dielectric spacers having a dielectric constant to properly electrically space the elements of the antenna from the conductive portions of the vehicle. When properly electrically spaced from the elements, the conductive structure provides the ground plane of the antenna. The present invention also contemplates the use of RF absorbers in critical areas to shield passengers from what otherwise might be harmful RF radiation and to prevent interference between adjacent antennas.

Therefore, an object of the present invention is to eliminate antennas that protrude beyond the bodywork of a motor vehicle.

Another object is to provide antennas for a wide range of frequencies and applications that can be buried in the bodywork of a motor vehicle.

Another object is to provide directional antennas for specific applications such as collision avoidance radar and satellite communication.

These and other objects and advantages of the present invention will become apparent to those skilled in the art after considering the following detailed specification together with accompanying drawings wherein.

DETAILED DESCRIPTION OF THE PREFERRED EMBODIMENTS

Figure 1:
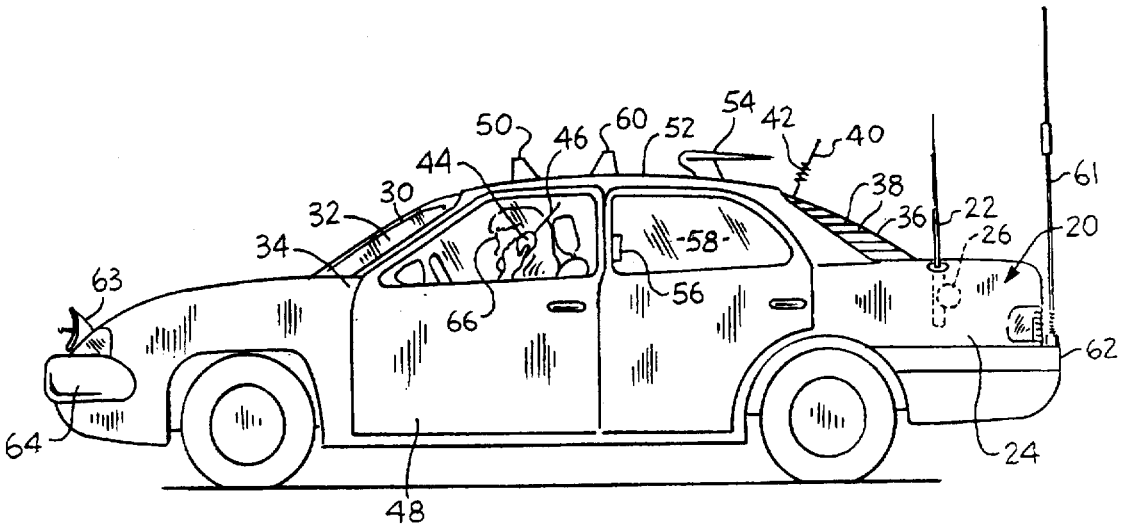
FIG. 1 PRIOR ART
FIG. 1 is a side elevational view of a prior art automobile showing various antennas that are presently in use.

Referring to the drawings more particularly by reference numbers, number 20 in FIG. 1 refers to an automobile having various antennas thereon constructed in accordance with the prior art. For example, the automobile 20 includes a telescoping whip antenna 22 useful in receiving broadcast AM and FM signals, which is powered to extend as shown or retract within the fender 24 by a motor 26. Instead of a whip antenna, sometimes motor vehicles use wire antennas, such as antenna 30 sandwiched in the plastic between the laminated glass layers of the front windshield 32. However, this makes the front windshield 32 expensive, and since the windshield 32 is soft mounted within the windshield frame 34, stress concentrations on the wire 30 can cause it to separate requiring replacement of the entire windshield 32 to maintain radio reception within the automobile 20. The antenna 30 normally cannot be placed in the rear window 38 because such commonly has conducting elements 36 of a rear window defroster on the inner surface thereof that interfere with the proper operation of an antenna like embedded wire antenna 30. An antenna 40, with its base loading coil 42, for a built-in cellular telephone is shown extending from the rear window 38. Such antennas 40 commonly are capacitively coupled through the glass of the rear window 38 losing RF power in the process. Some occupants of motor vehicles use hand-held cellular phones 44 so that the antenna 46 is partially shielded by the metallic body 48 of the vehicle 20. Recently, there have also been concerns that hand-held cellular phones 44 radiate RF energy at too high a power density to be safely used adjacent a human head.

Other less common antennas are also shown installed on the vehicle 20 including a global positioning system blade antenna 50 extending upwardly from the roof 52 of the vehicle 20, a broadcast television antenna 54 extending upwardly from the roof 52 to provide television reception for displays 56 viewable from the rear passenger compartment 58 of the automobile 20, a blade type satellite data communications antenna 60 extending upwardly from the roof 52, a center loaded amateur radio whip antenna 61 mounted on the rear bumper 62, and a collision avoidance radar antenna 63 positioned near the front bumper 64 of the vehicle 20.

All of the antenna heretofore mentioned either are vulnerable to damage because they protrude from the body 48 of the automobile 20 or include fragile connections, or radiate RF energy in close proximity to the occupants 66 of the automobile 20.

Figure 2:
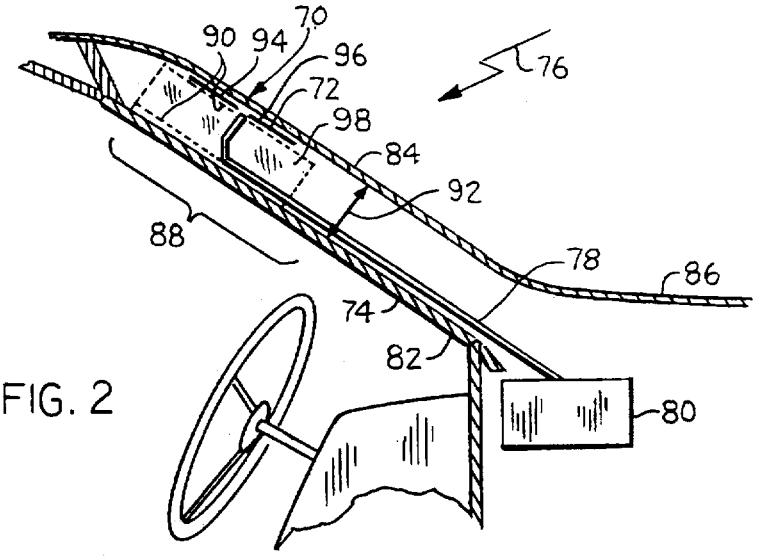
FIG. 2 is a diagrammatic cross-sectional view showing the present invention installed in a front roof support of a motor vehicle.

A generic diagrammatic version of an antenna system 70 for motor vehicles is shown in FIG. 2 wherein a dipole antenna 72 is positioned in the left front roof support 74 to receive radio transmissions 76 and feed the received signal along antenna feed line 78 to a receiver 80. The roof support 74 includes an electrically conducting support member 82 positioned behind the antenna 72 and a non-conducting antenna cover 84 shaped and preferably colored to blend in with the outer body surface 86 adjacent thereto. The cover 84 protects the dipole antenna 72 from rain, vandals and car wash machines. The half wave dipole antenna 72 may or may not be attached to the cover 84 while the conductive and grounded front roof support structure portion 88 beneath the antenna 72 serves as a back up or ground plane 90. Ideally, the separation distance 92 between the elements 94 and 96 of the antenna 72 and the ground plane 90 is one quarter wave length of the intended center frequency of the antenna 72 for best antenna to antenna feed matching purposes, but this separation is not necessarily required. A sheet of plastic 98 or other dielectric having a relative dielectric constant with respect to free space, $\epsilon$, may be placed between the antenna elements 94 and 96 and the ground plane 90 to render the electrical separation, as opposed to the physical separation 92 therebetween, equal to $\lambda/4$ when $\epsilon=\{\lambda/(4d)\}^2$, where $\lambda$ is the free space wave length of the center frequency of the radio band for which the antenna 72 is designed and d is the physical separation distance 92. Note that $\epsilon$ must be greater than unity. For most materials, $\epsilon$ is less than 100. For a few materials, $\epsilon$ is as large as 1200. For electrical matching purposes, $\epsilon$ should be as small as possible, and in some cases, a lateral variation of $\epsilon$ with distance is desirable.

Figure 3:
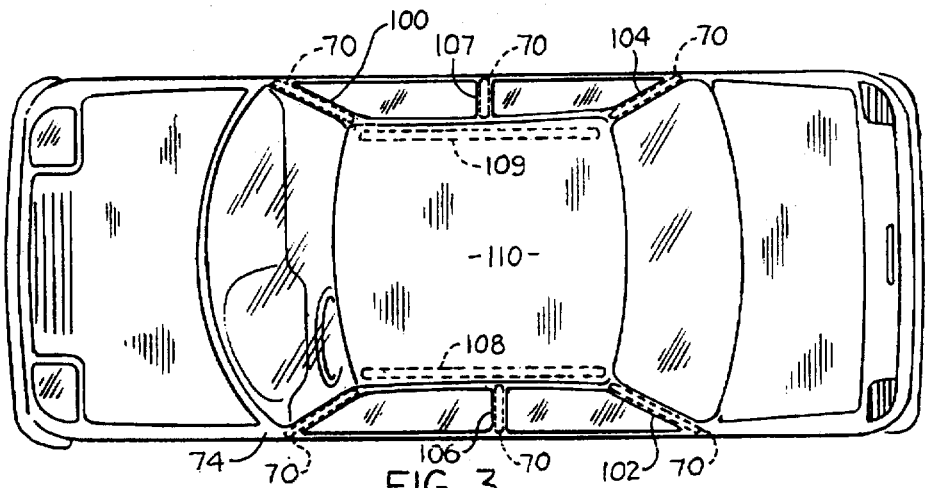
FIG. 3 is a top view of a motor vehicle showing various locations that the invention as embodied in FIG. 2 can be employed.

As shown in FIG. 3, the antenna system 70 can be placed in either the left front roof support structure 74, the right front roof support structure 100, the left rear roof support structure 102 or the right rear roof support structure 104. In addition, except on vehicles such as hard top convertibles that have no center roof support, the system 72 can also be installed in the left and right center roof supports 106 and 107 respectively. Decorative trim 108 and 109 can also be used to provide the invention along the sides of the roof 110.

Although, as shown in FIG. 2, the antenna system 70 was installed in front of the supporting structure 74 an antenna of the present invention can be incorporated as the supporting structure. This is shown diagrammatically in FIG. 4 wherein the center portion 111 of the left front support structure 112 of a vehicle 114 is used as an antenna element 116. As shown, the antenna element 116 is connected at its lower end 118 to an antenna feed 120 connected to the receiver 80 so that a half dipole antenna 122 is formed. The element 116 is isolated from the rest of the vehicle 114 by isolators 124 and 126 positioned respectively at the lower end 118 of the antenna 120 and the upper end 128.

Figure 4:
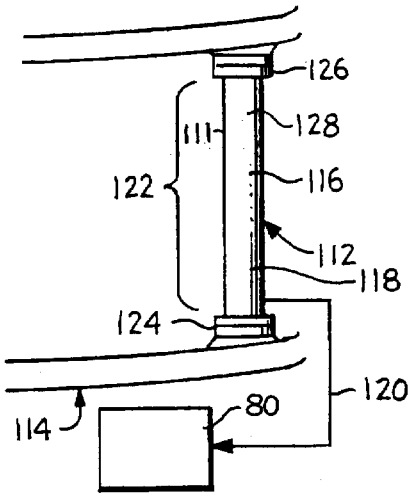
FIG. 4 is a diagrammatic front elevational view of a modified version of the present invention, wherein the antenna element forms a structural portion of the roof support structure of a motor vehicle.
Figure 5:
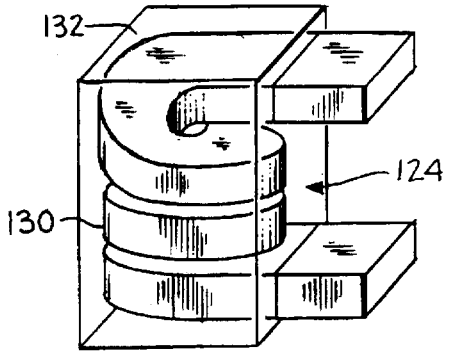
FIG. 5 is an enlarged detail view of the RF isolators used in the embodiment of FIG. 4.

The isolators 124 and 126 are essentially mirror images of each other with isolator 124 being shown diagrammatically enlarged in FIG. 5. The isolator 124 consists of an open two and one half turn coil 130 encased in a structural insulator block 132 which can be constructed from fiber reinforced epoxy. Electrically, the isolators 124 and 126 present a very high impedance especially at the 100 MHz FM broadcast frequencies. The coil 130 is constructed so that the inductance of the coil 130 is approximately resonant with the capacitance of the coil 130 in the 100 MHz range thereby presenting a very high impedance. The antenna 122 of FIG. 4 is also practical for higher frequencies but in most motor vehicles, other than large trucks, the structural support is too short for the antenna 122 to be used for AM broadcast reception without an impedance matching circuit such as an end loading coil.

Figure 6:
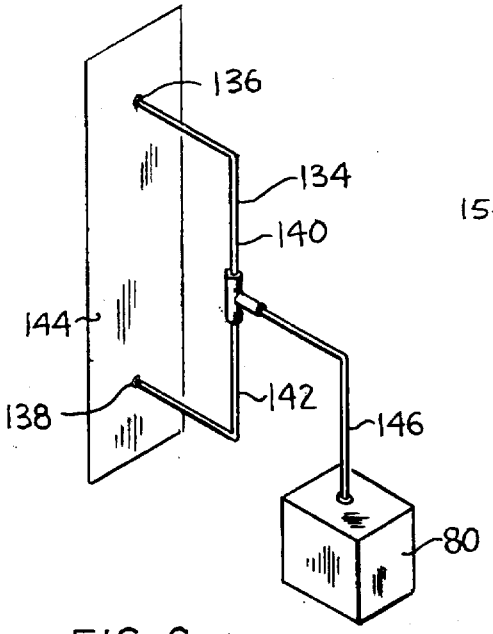
FIG. 6 is a diagrammatic view of a version of the present invention utilizing a folded dipole on a roof support.

As shown in FIG. 6, a folded dipole antenna 134 can be formed by bonding the ends 136 and 138 of its elements 140 and 142 respectively to a conducting roof support column 144, the elements 140 and 142 being connected to the receiver 80 by a feed 146 connected therebetween. Normally, the antenna 134 is shielded by a cover transparent to radio waves similar to cover 84.

Figure 7:
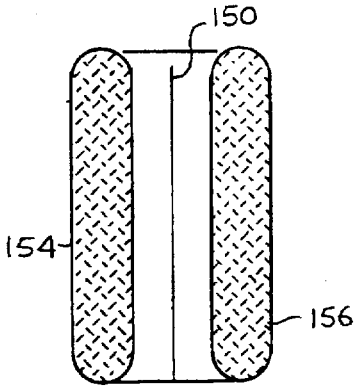
FIG. 7 is a front view of a radiating antenna incorporated into a roof support member having RF absorbing material incorporated therein to prevent unhealthful RF power densities being applied to occupants of a vehicle.
Figure 8:
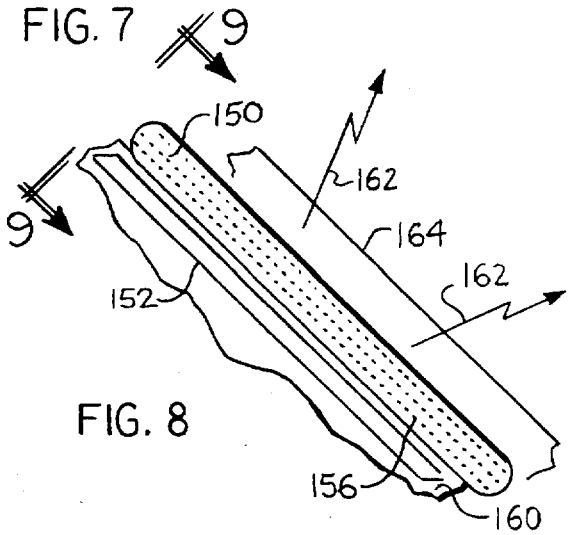
FIG. 8 is a side elevational view of the structure of FIG. 7.
Figure 9:
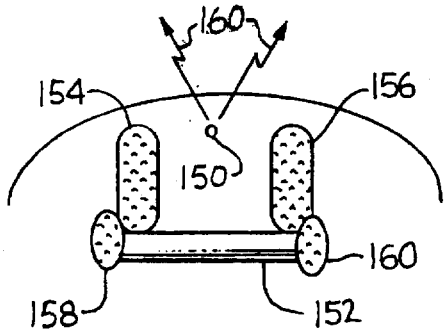
FIG. 9 is a top view taken at line 9—9 of FIG. 8.

RF absorbing material between a radiating antenna and the occupants of a vehicle can reduce the RF power density to which the occupants are exposed. Means to do this are shown in FIGS. 7, 8 and 9 wherein a radiating antenna 150 of a type herein described backed by a structural roof support 152 is laterally surrounded by absorber members 154, 156, 158 and 160 to restrict the radiation of the antenna 150 to the directions shown by arrows 162 through the cover 164. The RF absorber members 154, 156, 158 and 160 may not be necessary to limit RF power density on an occupant to OSHA's limit of 10 mW/cm$^2$ average, but it can be used as an additional safety factor, especially when the effects of long-term exposure to RF radiation are still being determined.

Figure 10:
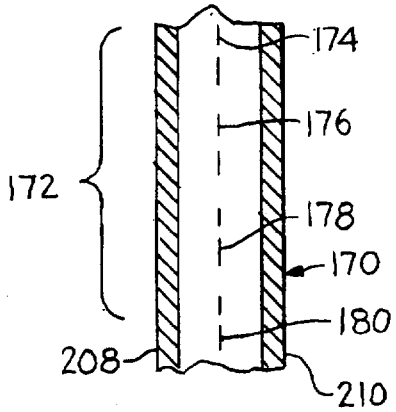
FIG. 10 is a front view of a phased dipole array version of the present invention.
Figure 11:
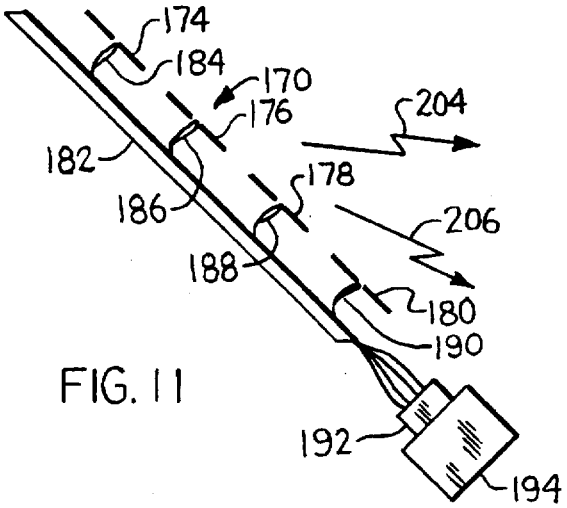
FIG. 11 is a side elevation view of the phased dipole array antenna of FIG. 10.
Figure 12:
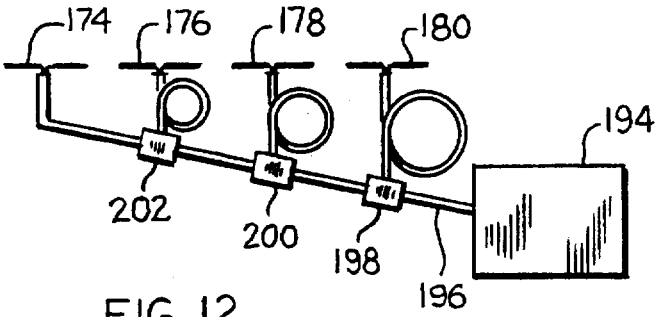
FIG. 12 is a diagrammatic view of the phased dipole array of FIGS. 10 and 11 showing modified passive phasing thereof.

A hidden antenna system 170 (FIGS. 10 and 11) including an array 172 of dipole antennas 174, 176, 178 and 180 can be provided on a roof support structure 182 for a motor vehicle radar. The array 172 of preferably vertically polarized, half wave dipoles 174, 176, 178 and 180 is shown for a frequency of about 1500 MHz. Because a roof support column 182 is usually at an angle as shown in FIG. 11, the phasing of each dipole 174, 176, 178 and 180 to cause proper beam takeoff angle is accomplished by varying lengths of feed line 184, 186, 188 and 190 respectively. This can be accomplished with four separate feed lines extending from an in phase four-way RF power splitter 192 connected to the radar 194 or, as shown in FIG. 12, the feed from the radar 194 may be a single feed 196 with power splitters 198, 200 and 202 which split off a quarter, a third and a half of the RF power respectively so it is evenly distributed between the dipoles 174, 176, 178 and 180. When the power splitters 198, 200 and 202 are used, the lengths of the feeds 184, 186, 188 and 190 between the power splitters 202, 200 and 198 and the dipoles 174, 176, 178 and 180 are chosen to adjust the phasing of the dipoles 174, 176, 178 and 180. This type of phasing is very simple and offers the advantage of beam slewing by altering the transmitting frequency. The array 172 is frequency sensitive to change the takeoff angle direction thereof, as shown by arrows 204 and 206, so that the radar 194 can move its beam to account for hills and valleys in front of the vehicle. The frequency and hence the beam elevation, are continually moved up and down to look for stalled objects or nearby objects on the highway. Absorbing material 208 and 210, as shown in FIG. 10, is used to protect the occupants of the vehicle, or at least to decrease the radio energy reaching the occupants. The radar energy needed for the automobile radar that has a range of 200 feet is very small, in fact so small that the occupants receive less than one billionth the energy that could harm a person according to the levels established by OSHA. This assumes that the radar antennas are two or three feet away from the occupants. For a cellular telephone held near the ear, the energy density is nearer but less than the OSHA limit.

Figure 13:
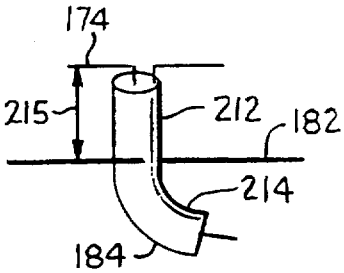
FIG. 13 is an enlarged detail view of a balun for the array of FIGS. 10 through 12.

As shown in FIG. 13, balun 212 can be used with each of the antenna elements with antenna element 174 being shown by bonding the outer conductor 214 of a coaxial feed line 184 to the conducting supporting structure 182 at a distance 215 that is a quarter wave length from the dipole antenna 174. The beam width of the array 172 can be tailored to be small enough to prevent ground reflections, provided a frequency of the x-band or above is used. Vertical polarization also reduces the intensity of ground reflections. Ground reflections reduce the energy on target.

The array of dipoles illustrated in FIGS. 11 and 12 produce a narrow beam in the vertical dimension, and a broad beam in the horizontal dimension. The beamwidth in the vertical dimension for 1500 MHz is about 17°. Dipoles 216, 217, 218, and 219, (FIG. 14) constructed like 174 (of the array of four dipoles shown in FIGS. 11 and 12) placed in each of four roof supports 74, 100, 102, and 104 of FIG. 3, are suitable for reception of frequencies radiated by the Global Positioning Satellites (GPS), which operate at 1200 to 1600 MHz. Slightly longer dipoles in the same locations are suitable for sending and receiving cellular telephone and pager messages. Shorter dipoles in the supports 74, 100, 102, and 104 can be used for higher frequencies than 1500 MHz, and wire antennas the length of the supports can serve as non-resonant antennas for receiving FM, AM, and TV broadcasts, and for Citizens Band Radio.

Many other types of antenna elements than dipoles 216, 217, 218, and 219 and whips can be placed in the automobile roof supports 74, 100, 102, and 104. Many types of small elements and ways of shortening the physical lengths of elements are shown in *Small Antennas,* by K. Fujimoto, A. Henderson, K. Hirasawa, and J. R. James, John Wiley, 1987. The physical lengths can be shortened, for example, by encasing the element in a dielectric, with a decrease in impedance.

Figure 14:
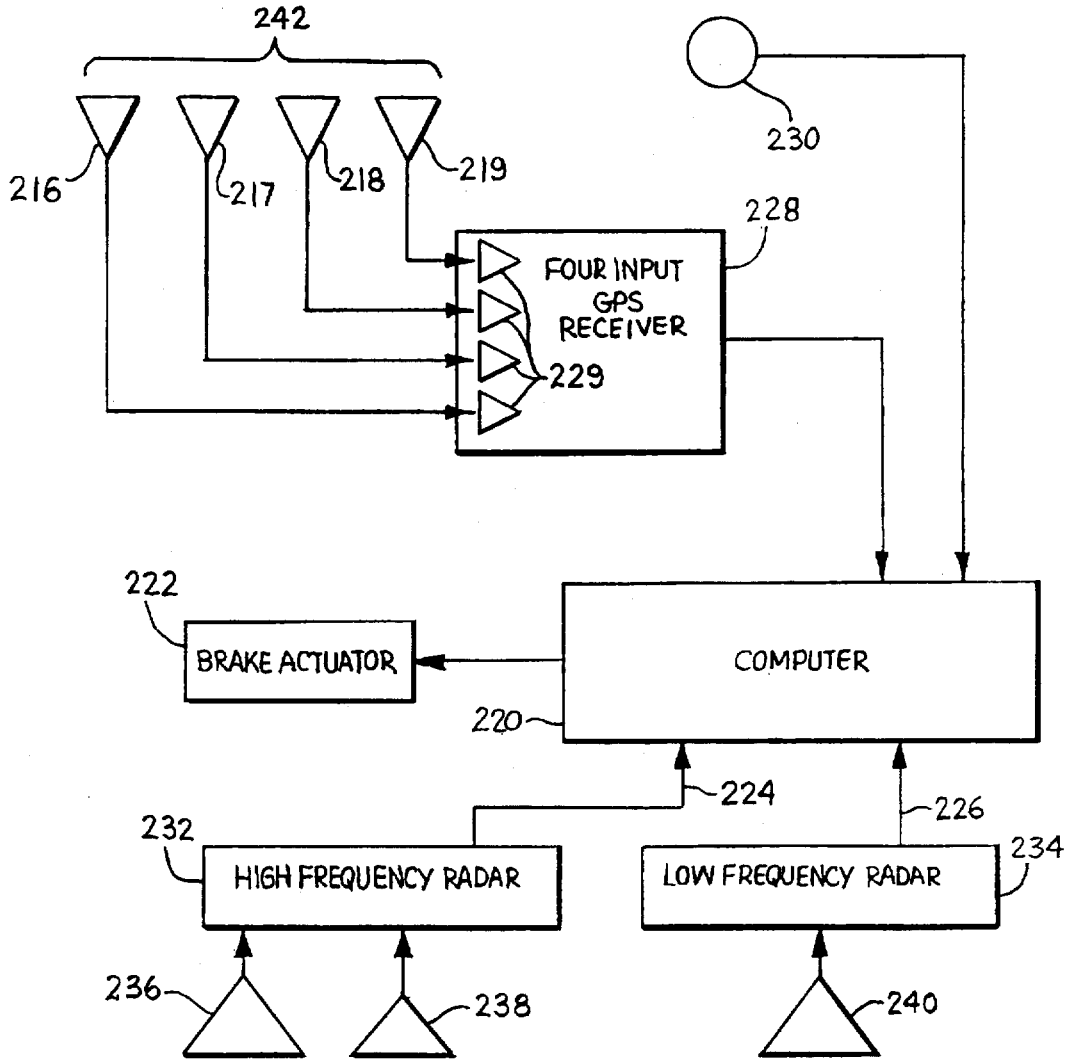
FIG. 14 is a block diagram of an automobile radar system showing a GPS system to determine location, and showing how the GPS system can deal with the problem of areas where the radars cannot perform well.

Vehicle radars for detecting road-blocking objects, and perhaps for automatically applying brakes when these objects are detected, will likely become a reality before the year 2010. A radar screen or display of some sort is expected to be located on the dashboard of the automobile. This screen would present objects in the road ahead to the driver, provided these objects are large and are not moving with traffic. When they are large, are not moving ahead rapidly or have more than a predetermined closure rate, and are within the stopping distance of the automobile, brakes will be applied automatically. At present, prototype systems have difficulty distinguishing sign posts, overpasses, and other such road objects, especially when they are located on curves. One way to overcome this problem is to use a GPS system that utilizes antennas in the four automobile roof supports 74, 100, 102, and 104. The first time that a spurious object causes alarm or an automatic brake application, the driver could depress an "ignore" button that tells the automatic braking system to ignore radar returns at that location when the automobile is traveling in the same direction in the future, provided the driver desires to do so. A block diagram of this system is shown in FIG. 14. A computer 220 and other logic circuitry well known in the art are required.

In FIG. 14 the computer 220 controls the brake actuator 222. Brakes are applied when both warning threshold signals 224 and 226, are present and fed to the computer 220, and when the GPS determined location does not inhibit the braking action. The GPS receiver 228 uses the antennas 216, 217, 218 and 219 whose outputs may be amplified individually by identical amplifiers 229. The GPS receiver 228 is connected to continually feed the coordinates of the automobile position and optionally the direction of motion to the computer 220. Whenever a particular road situation, such as a curve or road sign, produces a false alarm causing the brakes to be applied, the GPS receiver 228 provides position data that can be used to inhibit brake application. The first time that a false alarm occurs at a given location, the driver depresses a dashboard switch 230 to tell the computer 220 to store the position coordinates. Thereafter, when the vehicle is at that location (generally within a circle of up to 300 meters) and going the same general direction, the brake action will be inhibited.

The threshold signals 224 and 226 are present when a threatening object on the road is detected by the high frequency radar 232 and low frequency radar 234 within certain distance range limits, within certain velocity limits, and above an established threshold in amplitude, which is an indication of the size of the object on the road. The threshold signals must be adjusted or normalized for range, either by the radars 232 and 234 or by the computer 220. The adjustment is such that the amplitudes of the threshold signals are proportional to the radar cross section. The thresholds are chosen so that small objects will not produce an above-threshold signal at the radar outputs.

The large aperture automobile antenna system 236 and a small aperture automobile antenna system 238 serves high frequency radar 232 while a five element array 240 serves low frequency radar 234, in addition to the GPS antenna array 242. Two antenna systems 236 and 238, preferably operate at the frequency of 35 GHz or higher, while a five element array antenna system 240 operates at about 500 MHz. The two radars 232 and 234, one at 500 MHz and the other at 35 GHz, can operate simultaneously. The higher frequency, 35 GHz radar 232 is not sensitive to objects above the road, such as overpasses, and the lower frequency, 500 MHz radar 234, is not sensitive to physically small objects because of its longer wavelength. Detection by both radars 232 and 234 preferably can be required before brakes are automatically applied, even though a single radar may suffice in most cases.

Figure 15:
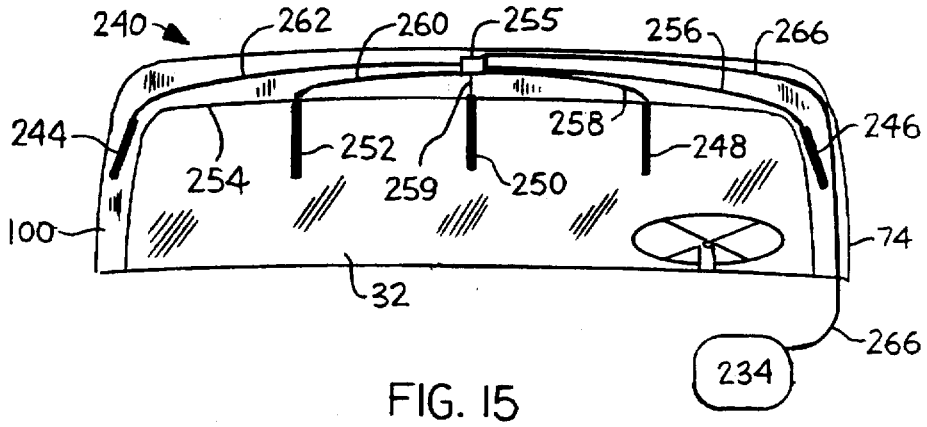
FIG. 15 is a front elevational view of a five-element radar array at 500 MHz.

The 500 MHz radar antenna system 240 is illustrated in FIG. 15. The system 240 includes five quarter-wave whip antennas 244, 246, 248, 250, and 252 with antennas 248, 250 and 252 being hung from the automobile roof 254 as shown. These elements are separated about 0.63 wavelengths. Two of the antenna elements 244 and 246 are in roof supports 100 and 74, with the elements, 248, 250, and 252, being glued to the inside of the windshield 32. The five antenna elements 244, 246, 248, 250 and 252 are interconnected by a summing circuit 255 with coaxial cables 256, 258, 259, 260 and 262 all equal in length except for an integral number of wavelengths, to produce a beam straight ahead of the automobile. If the beam is to be moved in azimuth, these cable lengths must be changed. As shown in FIG. 15, cables 256, 258, 259, 260, and 262 feed received power from antenna elements 244, 246, 248, 250, and 252 to the summing circuit 255. Cable 266 feeds the summed signal to the radar 234. During transmit, the radar feeds power by way of cable 266 to the circuit 255, which feeds equal powers to each of the elements. *Methods of Experimental Physics, Astrophysics,* Vol 12, Part B, Radio Telescopes, Ed. M. L. Meeks, Chapter 1.6; "Practical Problems of Antenna Arrays, by J. C. James, Academic Press, 1976, disclose other methods for interconnecting the antennas 244, 246, 248, 250, and 252. Alternatively, they could be interconnected with cables of varying length in order to move the beam to the right or to the left, as the front wheels are turned, provided the automobile manufacturers and experience shows this to be desirable. In this case, cables 256, 258, 259, 260, and 262 would be variable in length. At each whip antenna 244, 246, 248, 250 and 252, the shields of the feed cables are tied to the body of the vehicle. The three antenna elements 248, 250 and 252 on the windshield 32 can be thin wires or flat conducting transparent tape.

Figure 16:
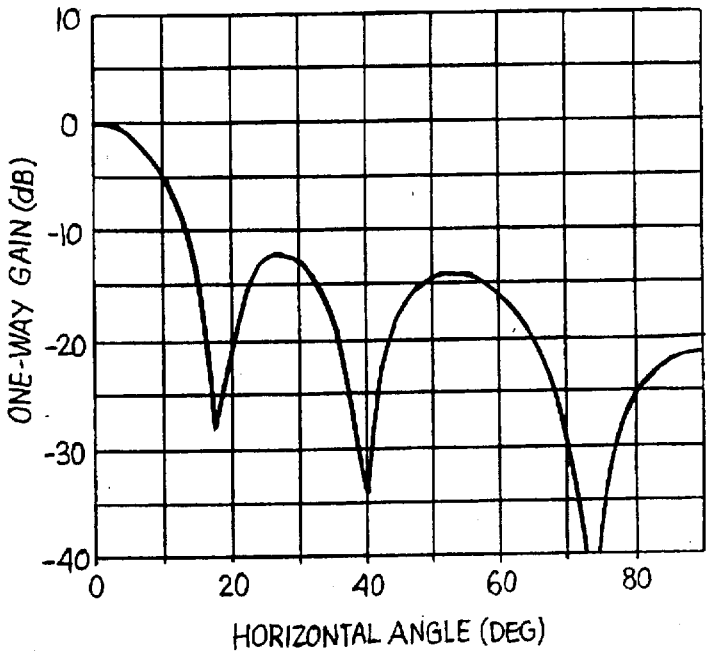
FIG. 16 is graph showing a typical horizontal antenna pattern for the five element radar array of FIG. 15.

A typical one-way antenna beam for the 500 MHz array is shown as FIG. 16. This is the horizontal dimension or azimuth angle of the beam. The vertical beamwidth is much larger. The small horizontal beamwidth provides little radar return from objects on each side of the road. The radiated power required for the radar 234 to detect one square meter objects or larger, 200 feet down the road is 2 milliwatts, peak, when ten pulses are coherently integrated or when one hundred pulses are incoherently integrated. A pulse repetition frequency of two hundred pulses per second is more than sufficient and produces an average power density on the front seat occupants of $7\times10^{-9}$ milliwatts per square centimeter (mw/sq cm). OSHA has specified that a human can continuously absorb 10 mw/sq cm without harm, but there has been some evidence that the OSHA limit is too high for long term exposure.

Figure 17:
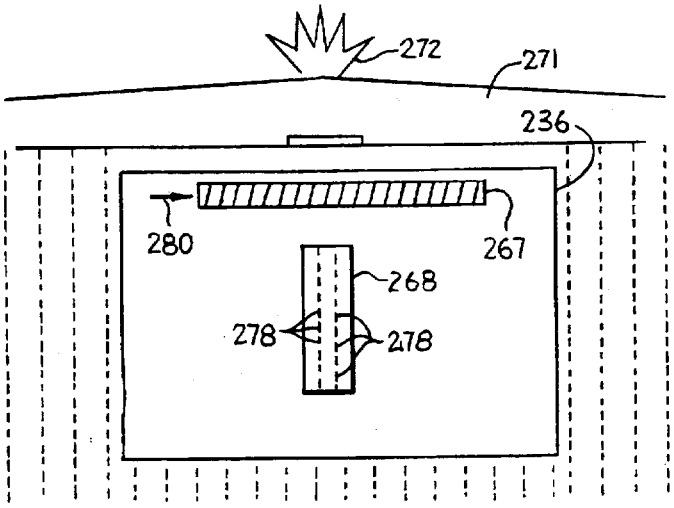
FIG. 17 is a front elevational view of an automobile 35 GHz radar antenna.
Figure 18:
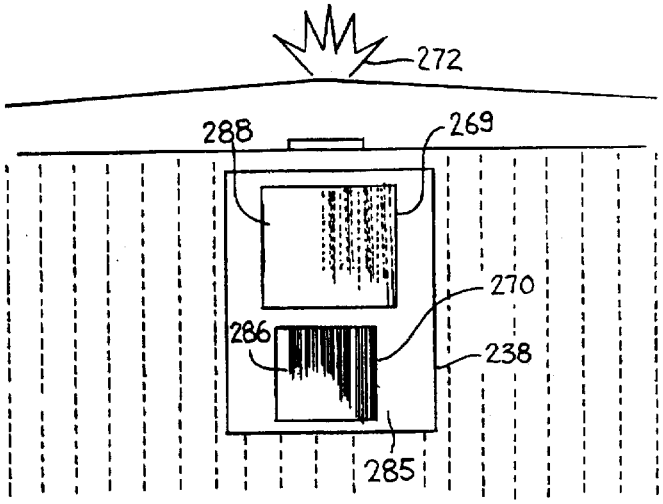
FIG. 18 is a front elevational view of filled arrays for an automobile 35 GHz radar antenna.

Antenna arrays 267 and 268, and 269 and 270 for the two 35 GHz systems 236 and 238 of FIG. 14 respectively, can be mounted in the top front grill 271 of the vehicle, under the hood ornament 272, as shown in FIGS. 17 and 18. Normally this would place the arrays from two to five feet above the road. Of the two antenna systems 236 and 238, one is for transmit and one for receive. FIG. 17 shows one embodiment and FIG. 18 shows another embodiment. Preferably, the arrays 267, 268, 269, and 270 are mounted behind plastic radomes (not shown) made from polyethylene or teflon for protection against flying debris damage.

The first 35 GHz system 236 is illustrated in FIG. 17. It includes two antenna arrays 267 and 268, one used for transmit and the other used for receive. It doesn't matter which is used for which. The tall array 268 can be a 10 cm (4 inch) by 1 cm (0.41 inch) array of dipoles 278. The dipoles 278 are 0.63 wavelengths apart, evenly spaced, and the array 268 is two dipoles wide and ten to twelve dipoles long. The other array 267 can be a slotted waveguide 20.3 cm (eight inches) long fed at one end 280. Both arrays 267 and 268 produce fan beams. The array 268 produces a beam narrow in azimuth and the other 267 produces a beam narrow in elevation. The two-way pattern is a pencil beam pointed along the road ahead of the vehicle. This pencil beam is the product of the two individual beams. The power required to detect a one square meter object 200 feet ahead of the vehicle is about 10 watts, which could cause a radiation hazard for a person standing in front of the vehicle. This hazard can be reduced by interlocking the radar transmitter so that it is always off when the vehicle is not moving above a minimal velocity. If the array 267 is made frequency sensitive, so that changing the carrier frequency causes the fan pattern to sweep in azimuth, the carrier frequency can be varied with steering wheel position to sweep the resultant pencil beam in the direction of any turn.

Figure 19:
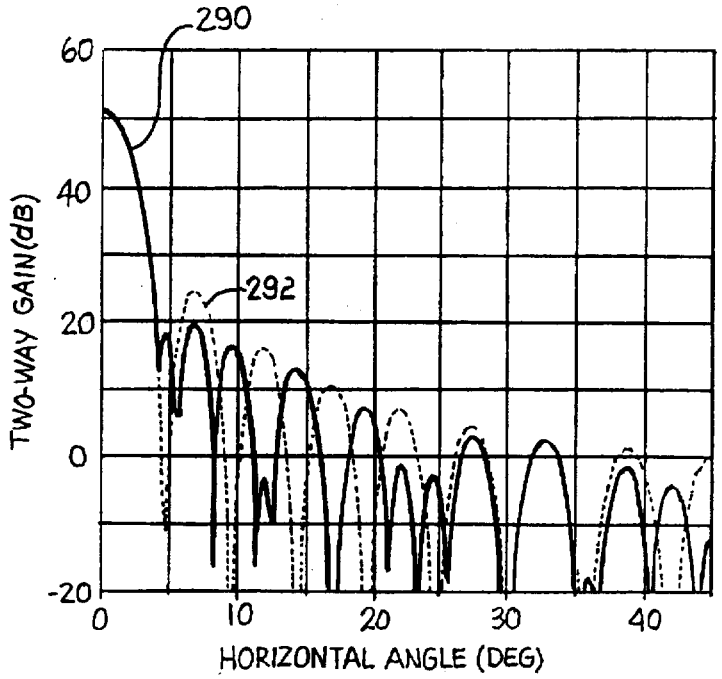
FIG. 19 is a graph of typical two way gains of 35 GHz radar arrays vs. horizontal angle.

The second 35 GHz system 238 is illustrated in FIG. 18. It consists of two filled arrays 269 and 270 of half wave dipoles over a ground plane 285. Array 270 has 16×16 elements 286 and array 269 has 22×22 elements 288. The two way pattern 290, resulting from one array transmitting and the other array receiving, for these two arrays 269 and 227 is shown in FIG. 19. Also shown in FIG. 19 is the two way pattern 292 for a single antenna having the same two way gain. The apertures of the two arrays 269 and 270 in FIG. 18 are such that the first sidelobe of the larger array 269 coincides with the first null of the smaller array 270, thus producing smaller two way sidelobes than the comparison single array. Furthermore, when the two arrays 269 and 270 are used, no transmit-receive devices are needed. A transmit-receive (TR) device is some sort of switch to prevent transmitter energy from damaging the receiver. The TR device also directs received antenna energy to the receiver during receive, and transmitter energy to the antenna during transmit. A TR device can be very lossy, especially at frequencies of 35 GHz and higher. The transmitter power needed for detecting a one square meter target two hundred feet down the road when the antenna system 238 of FIG. 18 is used is only 100 milliwatts. This power is less than the power required for the antenna system 236 in FIG. 17 because of the larger antenna gains. There is no radiation hazard for this antenna system 238 even when a person is standing directly in front of the antenna because the power is spread over the array to produce a power density less than 10 mw/sq cm.

Figure 20:
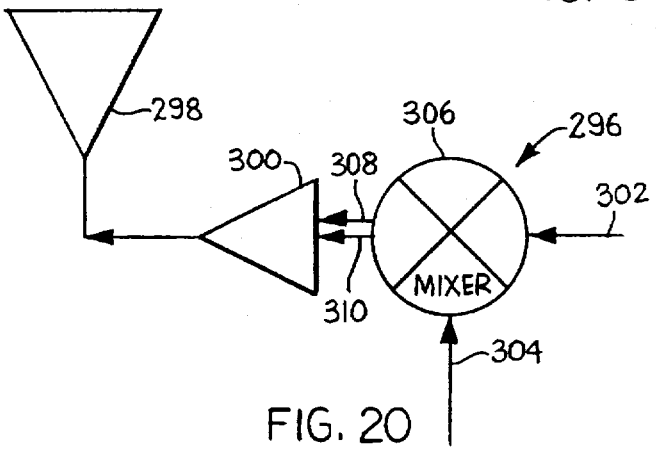
FIG. 20 is a schematic diagram of electronic components feeding each element of a transmit radar array.

FIG. 20 shows in schematic form, the circuit 296 immediately behind each radiating dipole of the transmit antenna of FIGS. 17 and 18. The antenna element 298 was described above as a half wave dipole above a ground plane, but it could be another type element. Feeding each element 298 is a 35 GHz amplifier 300, which can be constructed to be very small in physical size. An exciter pulse 302 and a local oscillator signal 304 are fed from the radar. At each element, the exciter pulse 302 and the local oscillator signal 304 mix in the mixer 306 to produce sum and difference frequencies 308 and 310 to the amplifier 300, one of which is 35 GHz. Although both the sum and difference signals 308 and 310 are fed to the amplifier, only the 35 GHz signal is radiated because the circuit elements are cut for that frequency and the other frequency is effectively filtered out. If phasing were desired to move the beam in azimuth, each column of dipoles would be fed by a phase shifted exciter pulse, but this is likely too much complication for an automobile antenna. Beam movement may not be needed.

Figure 21:
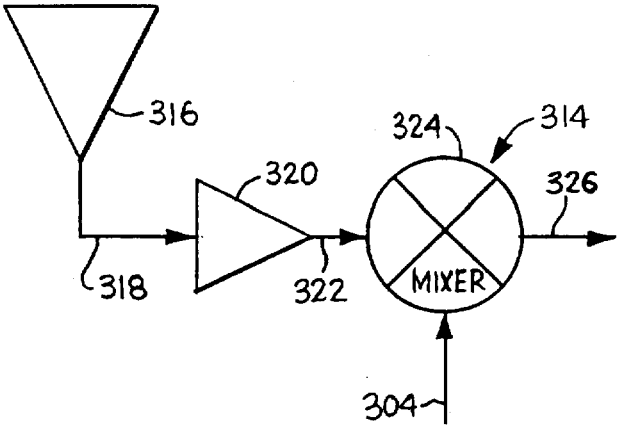
FIG. 21 is a schematic diagram of electronic components for each element of a receive radar array.

FIG. 21 shows in schematic form, the circuit 314 immediately behind each receiving dipole of the receiving antenna 316 of FIGS. 17 and 18. The antenna element 316 receives a radar echo signal 318. This signal 318 is amplified by amplifier 320, which is located behind the ground plane from the antenna element 316. Each element has an amplifier. The amplified signal 322 is then mixed in mixer 324 with the local oscillator signal 304 to produce IF output 326. The outputs 326 from all elements are summed to produce the total radar output, which is then scaled for range and tested for amplitude. When the summed, scaled, and tested signal is above a set threshold, it is fed to the computer 220. A particular design could have the computer 220 do the scaling and testing rather than the radar. The dividing line between radar and computer is vague since most radars need computers and a computer may be considered part of the radar.

The frequency of the radar 232 could be almost any frequency between 20 GHz and 100 GHz with a corresponding adjustment in the size of the arrays needed to produce a beam of a given angle. Some frequencies above 35 GHz have high propagation loss due to oxygen and water vapor absorption, but because the range of the automobile radar is short, the attenuation is not great.

Figure 22:
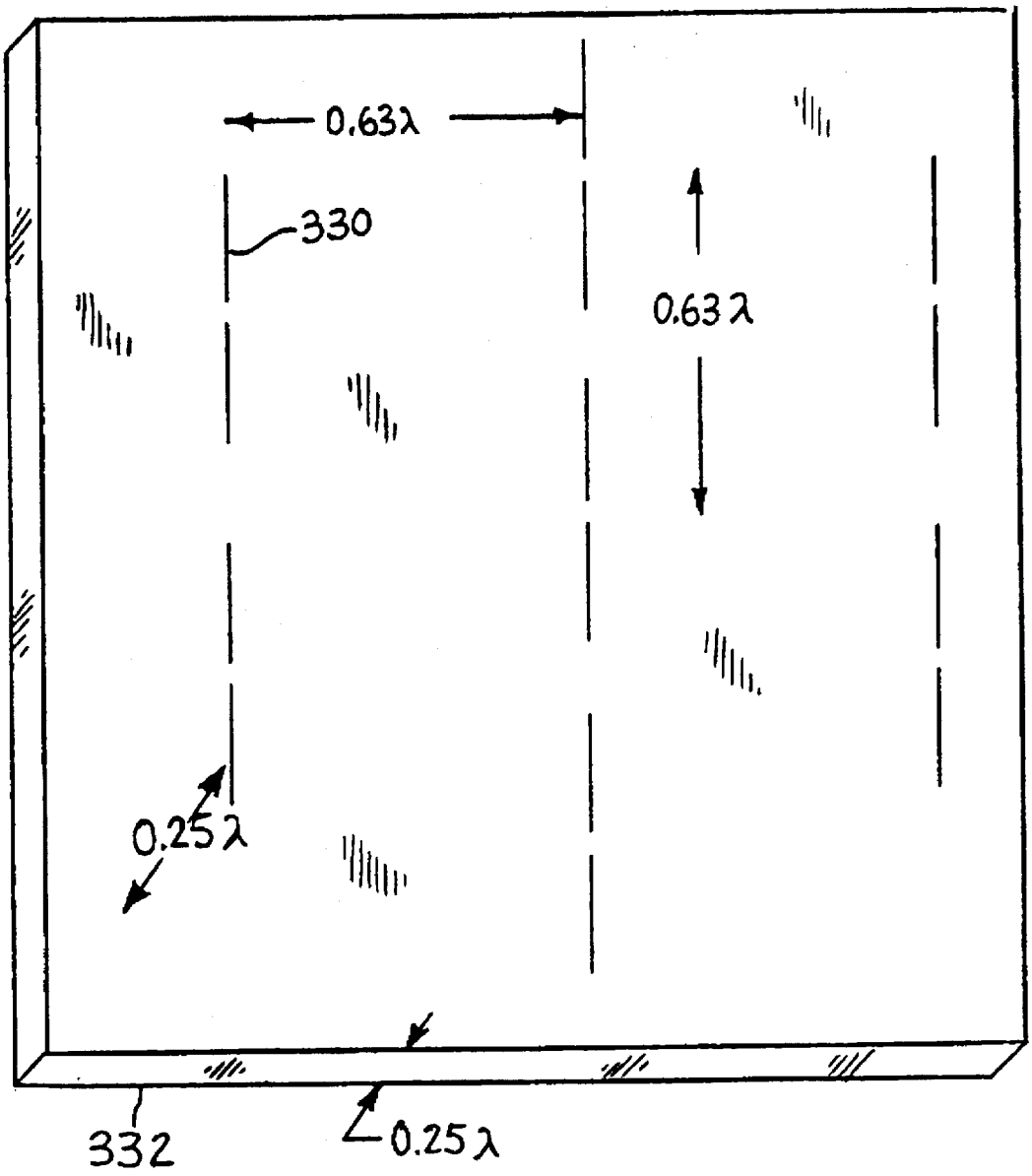
FIG. 22 is a section of a dipole array showing element spacings.

The dipoles in the arrays should be separated about 0.63 wavelengths to prevent grating lobes and to prevent serious mutual coupling. A discussion of the reasons for this separation, and for related array problems is included in the J. C. James chapter referenced above. A preferred spacing and location of dipoles 330 is shown in FIG. 22. The dipoles 330 should be one fourth wavelength above a ground plane 332. The electronics shown in FIGS. 20 and 21 usually are located behind the ground plane 332.

It should be understood that with all the antennas described, construction therein will be much simplified when motor vehicle support columns are commonly made from very strong composite materials that are non-conductors, since this simplifies the placement of antenna elements in the support column region. It should be realized that any of the antennas described herein can be located as shown in FIG. 3 although the array 172 would normally be placed in the supports 74 or 100 or both.

Thus, there has been shown and described novel hidden antennas which fulfill all of the objects and advantages sought therefor. Many changes, alterations, modifications and other uses and applications of the subject antennas will become apparent to those skilled in the art after considering this specification together with the accompanying drawings. All such changes, alterations and other modifications which do not depart from the spirit and scope of the invention are deemed to be covered by the invention which is limited only by the claims that follow:

We claim:

1. An antenna system at least partially located in a roof support column of a motor vehicle comprising:

an antenna element;

a conductive surface spaced from said antenna element;

antenna feed means connected to said antenna element; and means to electrically isolate said antenna element from the motor vehicle;

wherein said antenna element includes:

an upper end; and a lower end, and wherein said means to electrically isolate said antenna element from the motor vehicle include:

a first coil located adjacent said upper end of said antenna element;

a first electrically insulating structure surrounding said first coil;

a second coil located adjacent said lower end of said antenna element; and a second electrically insulating structure surrounding said second coil, said first and second electrically insulating structures and said antenna element forming at least a portion of a roof support column of the motor vehicle.

2. The antenna system as defined in claim 1 wherein said first and second coils each have:

a similar number of turns, spaced and shaped so the inductance and capacitance of said first coil are about equal at the center frequency of the antenna element, and the inductance and capacitance of said second coil are about equal at the center frequency of the antenna element, whereby said first and second coils present high impedances to said upper and lower ends of said antenna element.

3. An antenna system at least partially located in a roof support column of a motor vehicle comprising:

an antenna element;

a conductive surface spaced from said antenna element;

antenna feed means connected to said antenna element; and means to electrically isolate said antenna element from the motor vehicle;

wherein said antenna element includes a half wave dipole spaced generally parallel to said conductive surface, and wherein said means to electrically isolate said antenna element from the motor vehicle includes a dielectric spacer positioned between said conductive surface and said half wave dipole.

4. The antenna system as defined in claim 3 wherein, said dielectric spacer has a dielectric constant, $\epsilon$, equal to $\{\lambda/$ (4d)}$^2$, where λ=free space wave length of the center frequency of said antenna element, and where d=the physical distance between said half wave dipole and said conductive surface.

5. The antenna system as defined in claim 3 further including:

a non-conducting cover extending from said conductive surface over said antenna element faired in with the roof support column of the motor vehicle.

6. An antenna system for a motor vehicle comprising:

an antenna element;

a conductive surface spaced from said antenna element;

antenna feed means connected to said antenna element;

means to electrically isolate said antenna element from the motor vehicle; and a roof support column of the motor vehicle, said roof support column being electrically conductive and having:

an upper portion; and a lower portion, wherein said antenna element is a folded dipole including:

an upper end connected to said upper portion of said roof support column;

a lower end connected to said lower portion of said roof support column; and a center connected to said antenna feed means.

7. An antenna system at least partially located in a roof support column of a motor vehicle comprising:

an antenna element;

a conductive surface spaced from said antenna element;

antenna feed means connected to said antenna element; and means to electrically isolate said antenna element from the motor vehicle;

wherein said antenna element includes a plurality of half wave dipole antennas aligned in a linear array generally parallel to said conductive surface, and wherein said antenna feed means include a plurality of feed lines of lengths to phase RF energy fed to said plurality of half wave dipole antennas to produce a frequency sensitive RF beam whose launch direction can be adjusted by changes in the frequency of the RF energy fed to said plurality of half wave dipole antennas.

8. The antenna system as defined in claim 7 further including:

RF absorber spaced from said plurality of half wave dipole antennas and positioned adjacent said conductive surface and between said plurality of half wave dipole antennas and the interior of the motor vehicle.

9. The antenna system as defined in claim 8 wherein each half wave dipole antenna includes:

a first half dipole; and a second half dipole, and wherein each of said plurality of feed lines is a coaxial cable having:

a center conductor connected to said first half dipole; and an outer sheath connected to said second half dipole and to said conductive surface one quarter wave from said second half dipole.

10. The antenna system as defined in claim 7 wherein each of said plurality of half wave dipole antennas is connected to a one of said plurality of feed lines, each one of said plurality of feed lines having a length to phase said half wave dipole antennas connected thereto.

11. An antenna system for a motor vehicle wherein the motor vehicle includes first and second front roof support columns and at least first and second rear roof support columns, the antenna system comprising:

an antenna element positioned in the first front roof support, a conductive surface spaced from said antenna element;

antenna feed means connected to said antenna element; and means to electrically isolate said antenna element from the motor vehicle;

wherein said antenna system further comprises:

a second antenna element located in the second front roof support;

a third antenna element located in the first rear roof support;

a fourth antenna element located in the second rear roof support; and a GPS receiver connected to said antenna elements.

12. An antenna system as defined in claim 11 further comprising:

a first amplifier connecting an output amplified thereby from said first antenna element to said GPS receiver;

a second amplifier connecting an output amplified thereby from said second antenna element to said GPS receiver;

a third amplifier connecting an output amplified thereby from said third antenna element to said GPS receiver; and a fourth amplifier connecting an output amplified thereby from said fourth antenna element to said GPS receiver.

13. An antenna system for a motor vehicle which includes first and second front roof support columns with a windshield therebetween, the antenna system comprising:

a first antenna element positioned in the first front roof support, a conductive surface spaced from said first antenna element;

antenna feed means connected to said first antenna element; and means to electrically isolate said first antenna element from the motor vehicle;

wherein said antenna system further comprises:

a second antenna element located in the second front roof support;

a third antenna element located along the windshield midway between said first and second antenna elements;

a fourth antenna element located along the windshield midway between said first and third antenna elements;

a fifth antenna element located along the windshield midway between said second and third antenna elements;

a first collision avoidance radar system connected to said antenna elements for operation in a first frequency band;

a second collision avoidance radar system for operation in a second frequency band higher than said first frequency band;

a first array of antenna elements connected to said second radar facing forward having:

a first aperture; and a second array of antenna elements connected to said second radar facing forward having:

a second aperture smaller than said first aperture.

14. The antenna system as defined in claim 13 further including:

logic means connected to said first and second collision avoidance radars, each having outputs fed to said logic means, said logic means producing therefrom a automatic brake application signal.

15. The antenna system as defined in claim 14 further including:

a GPS receiver connected to said logic means to feed location information thereto; and programming means for said logic means to record locations of false production of automatic brake signals to suppress said automatic brake signals at recorded locations of previously unneeded production of said automatic brake signals.

16. The antenna system as defined in claim 15 wherein said GPS receiver is connected to said logic means to feed direction of travel signals, said programming means also recording direction information so that automatic brake signals are suppressed in a direction of travel at a location.

17. An antenna system for a motor vehicle which includes first and second front roof support columns with a windshield therebetween, the antenna system comprising:

a first antenna element positioned in the first front roof support, a conductive surface spaced from said first antenna element;

antenna feed means connected to said first antenna element; and means to electrically isolate said first antenna element from the motor vehicle;

wherein said antenna system further comprises:

a second antenna element located in the second front roof support;

a third antenna element located along the windshield midway between said first and second antenna elements;

a fourth antenna element located along the windshield midway between said first and third antenna elements;

a fifth antenna element located along the windshield midway between said second and third antenna elements; and a collision avoidance radar system connected to said antenna elements for operation in a first frequency band, whereby said antenna elements are quarter-wave elements capable of radiating signals from said first collision avoidance radar.

18. An antenna system for a motor vehicle which includes first and second front roof support columns with a windshield therebetween, the antenna system comprising:

a first antenna element positioned in the first front roof support, a conductive surface spaced from said first antenna element;

antenna feed means connected to said first antenna element; and means to electrically isolate said first antenna element from the motor vehicle;

wherein said antenna system further comprises:

a collision avoidance radar system:

a first antenna array connected to said radar system having:

a first aperture; and a second antenna array connected to said radar system having:

a second aperture half the size of said first aperture.

19. The antenna system as defined in claim 18 wherein said first and second array of antenna elements are located in the front grill area of the motor vehicle, wherein said first antenna array is:

a horizontal slotted waveguide about 12 wavelengths in length; and wherein said second antenna array includes:

two rows of dipoles separated about 0.63 wavelengths apart, said two rows of dipoles being vertically oriented.

* * * * *